US006422156B1

(12) United States Patent
Winsor et al.

(10) Patent No.: US 6,422,156 B1
(45) Date of Patent: Jul. 23, 2002

(54) RAILWAY BOX CAR STRUCTURE

(75) Inventors: Robert B. Winsor, Montreal; Jean-François Pharand, Lachine; Ronald F. Woollam, Abercrombie; John-John Dratva, Pierrefonds; Jean Iorio, Rosemere, all of (CA); Mell R. Thoman, Plano, TX (US)

(73) Assignee: IEC - Holden Inc., Montreal (CA)

( * ) Notice: Subject to any disclaimer, the term of this patent is extended or adjusted under 35 U.S.C. 154(b) by 0 days.

(21) Appl. No.: 09/578,292

(22) Filed: May 25, 2000

(51) Int. Cl.[7] ..... B61D 3/08; B61D 17/04
(52) U.S. Cl. ..... 105/355; 105/404; 105/422
(58) Field of Search ..... 105/355, 374, 105/404, 409, 422

(56) References Cited

U.S. PATENT DOCUMENTS 3,866,546 A * 2/1975 Malo ..... 105/410
3,996,861 A * 12/1976 Santho ..... 105/480
4,647,101 A * 3/1987 Ruggeri ..... 105/404
5,181,474 A * 1/1993 Miller ..... 105/355
5,287,814 A * 2/1994 Masai et al. ..... 105/422
5,802,984 A * 9/1998 Thoman et al. ..... 105/404
5,988,074 A * 11/1999 Thoman ..... 105/404

* cited by examiner

*Primary Examiner*—Joseph D. Pape
*Assistant Examiner*—Greg Blankenship
(74) *Attorney, Agent, or Firm*—Carter & Schnedler, PA.

(57) ABSTRACT

An improved railway car body structure is described. One of the features of the box car is that the longitudinal side walls are formed by a plurality of spaced apart vertical side posts which are hat-shaped in cross-section and define a bottom wall portion, opposed side walls and opposed end flanges extending in a common plane. Horizontal structural stiffeners are secured between the vertical side posts. The stiffeners define a recessed wall portion aligned with a recessed formation formed in the opposed end flanges of the vertical side posts. Ferrous sheet members are secured to the side wall and also to the end frames by welds disposed in the recess wall portion of the stiffeners and recessed formation of the vertical posts to form flush, unobstructed, inner side and end walls of the railway car. A new roof structure is also described and incorporates improved skylight designs.

24 Claims, 8 Drawing Sheets

RAILWAY BOX CAR STRUCTURE

TECHNICAL FIELD

The present invention relates to an improved railway box car body structure and particularly to a structure wherein the longitudinal side walls are comprised of a plurality of vertical side posts and structural horizontal stiffeners interconnected in such a way as to accommodate a recessed horizontal interconnection of ferrous sheet members to form flush inner side surfaces which are free of any obstructing elements not to damage shifting cargo transported by the box car.

BACKGROUND ART

U.S. Pat. No. 5,287,814 describes a car body for a railway car and particularly for passenger cars and wherein the side wall structure is formed with steel posts, stiffeners, rails, window heads and these are joined by brackets and outer side plates secured to the frame members by blind rivets.

U.S. Pat. No. 3,866,546 relates to a box car end structure which is the type of railway rolling stock cars that the present invention relates. This patent typifies some of the problems that the present invention wishes to overcome. For example, the flat end wall liner is affixed by welding or by the use of mechanical fasteners to secure it to the end wall frame members. These welds or fasteners will cause damage to cargo if the cargo is thrust against the wall by sudden braking or acceleration of the railway car. This is particularly hazardous when the lading is a fragile material such as paper rolls. Any kink in the roll is transmitted through many paper sheet layers and accordingly the roll has to be discarded or its value is greatly reduced. Such damaged rolls also require further handling and insurance claims and require more effort on the part of all concerns. Accordingly, it can be seen that damage to such lading is troublesome and very costly.

There is also a need to provide better lighting in these box cars. U.S. Pat. No. 5,988,074 describes an improved composite roof structure for a railway car and wherein skylights are incorporated all along the roof structure. The skylights are designed such as to be aerodynamic and provide a flush interior surface whereby to minimize damage during loading and unloading of the railway car. This patent is not concerned with load shifting but particularly damage to products during the loading and unloading process when the product is manipulated inside the box car by forklift trucks during loading and unloading.

While passenger railway car bodies have been greatly improved in the past, very little design work has been directed to improving box car designs whereby to transport goods in a safer and more efficient manner.

SUMMARY OF INVENTION

It is therefore a feature of the present invention to provide a railway box car structure having an improved longitudinal side wall structure whereby the inner ferrous sheet cladding forms flush inner side walls free of any obstructions.

Another feature of the present invention is to provide a railway box car side wall structure comprising hat-shaped vertical side posts having structural flanges and horizontal stiffeners also having structural flanges and interconnected together to accommodate a recessed horizontal interconnection of the inner side wall ferrous sheet cladding.

Another feature of the present invention is to provide an improved roof frame with stiffeners and capable of incorporating therein skylights of improved design.

According to the above features, from a broad aspect, the present invention provides a railway box car body structure comprising a flooring structure, a side wall on both longitudinal sides of the flooring structure and extending thereabove. An end frame is provided at opposed transverse ends of the flooring structure between opposed ends of the side walls. A roof frame constitutes an upper surface of the body structure. The side wall has a plurality of spaced-apart vertical side posts. The vertical side posts each have a hat-shaped cross-section having a bottom wall portion, opposed side walls and opposed end flanges aligned in a common plane. Horizontal structural stiffeners are secured between the vertical side posts. The stiffeners define a recessed wall portion aligned with a recessed formation formed in the opposed end flanges of the vertical side posts. Ferrous sheet members are secured to the side wall and end frames by recessed horizontal connections formed in the recessed wall portion to form flush inner side walls of the railway box car.

According to a further broad aspect of the present invention there is provided a railway box car body structure which comprises a flooring structure, a side wall on both longitudinal sides of the flooring structure and extending thereabove, and an end frame at opposed transverse ends of the flooring structure between opposed ends of the side walls. A roof frame constitutes an upper surface of the body structure. The roof frame is comprised by a roof panel assembly having spaced-apart transverse roof stiffeners. The roof stiffeners are of L-shaped cross-section defining a vertical connecting web and a transverse outer angle structural flange. A ferrous roof sheeting is secured to the connecting webs of opposed transverse stiffeners spaced below the structural flange. The roof sheeting is secured to the webs by attachment means to provide for a weatherproof connection and a flush unobstructed interior roof surface.

According to a still further broad aspect of the present invention there is provided a railway box car body structure which comprises a flooring structure, a side wall on both longitudinal sides of the flooring structure and extending thereabove, and an end frame at opposed transverse ends of the flooring structure between opposed ends of the side walls. A roof frame constitutes an upper surface of the body structure. The roof frame includes one or more skylight modules. The modules each have a circular sealing ring secured about a circular hole formed in a ferrous roof sheeting of the roof framing. An outer circular skylight disc is provided and has a translucent panel section and a circumferential depending circular connecting flange. A seal compressing annular flange projects about the disc in an uppermost region of the depending connecting flange. A clamping inner circular ring is provided and has a circular cavity thereabout configured to receive an end section of the depending circular connecting flange in close fit therein. Fastener means are provided for clamping engagement of the inner circular ring with the circular connecting flange whereby to squeeze the circular sealing ring between the annular flange of the disc and a sealing ring clamping surface of the clamping inner circular ring.

BRIEF DESCRIPTION OF DRAWINGS

A preferred embodiment of the present invention will now be described with reference to the accompanying drawings in which:

FIG. 18A is a plan view showing the skylight module secured to the roof panel assembly of the present invention;

FIG. 18B is a fragmented section view showing the end connection of the roof panel with respect to the roof module stiffeners and the skylight connecting circular flange;

DESCRIPTION OF PREFERRED EMBODIMENTS

Figure 1:
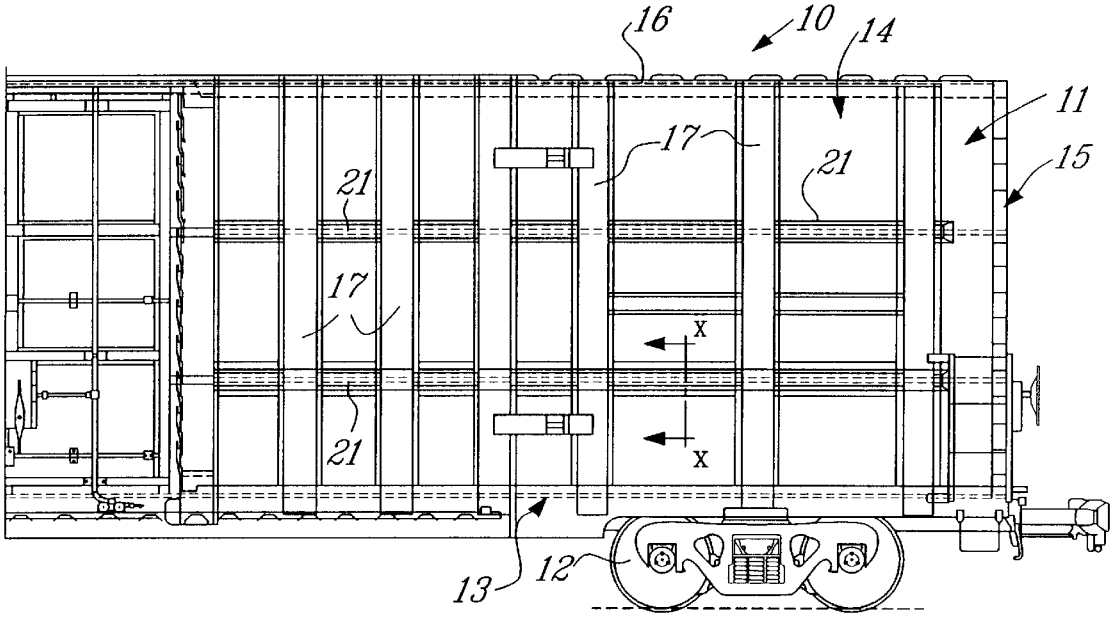
FIG. 1 is a side view of a portion of a railway box car showing the body structure of the present invention.

Referring now to the drawings and more particularly to FIG. 1, there is shown generally at 10 a railway box car constructed in accordance with the present invention. The railway box car 10 consists essentially of a body structure 11 which is supported on trucks 12. The body structure 11 is defined by a flooring structure 13, a side wall structure 14 secured on both longitudinal sides of the flooring structure 13 and an end frame structure 15 at opposed transverse ends of the flooring structure 13 and secured between opposed ends of the side wall structure 14. A roof frame 16 is secured over the side and end walls. of particular importance to the railway box car of the present invention is the construction of its side wall structure. This side wall structure 14 will now be described with further reference to FIGS. 2 to 5. The side wall structure 14 is formed by a plurality of spaced-apart vertical side posts 17. The vertical side posts 17, as shown in FIG. 4, are hat-shaped in cross-section and have a bottom wall portion 18, integrally formed opposed side walls 19 which terminate in opposed end flanges 20 which are aligned in a common plane.

Horizontal structural stiffeners 21 are secured between the vertical side posts 17. The horizontal stiffeners 21, as better seen from FIGS. 3 and 5, are of low profile hat-shaped cross-section and have a recessed wall portion 22, opposed stiffening arms 23 and structural end flanges 24 formed integral with the stiffening arms 23 and also aligned in a common plane.

Figure 5:
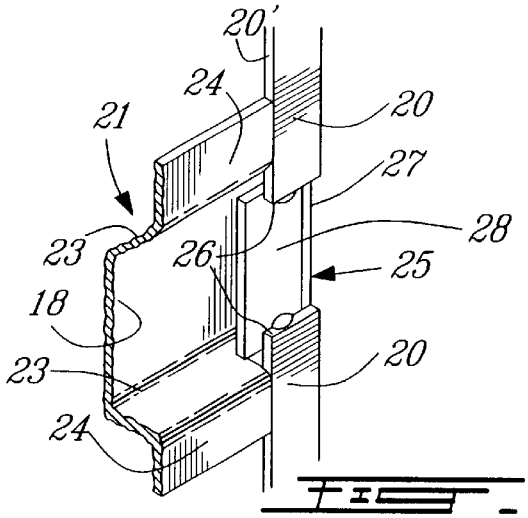
FIG. 5 is a perspective view showing the interconnection of the horizontal stiffeners with the vertical posts and particularly with relation to the recess formations formed in the opposed end flanges of the vertical posts.

As shown more clearly in FIG. 5, the opposed end flanges 20 of the vertical posts 17 have a recessed formation 25, or cut-out portions, formed at a predetermined location in opposed end flanges 20 of the vertical post and aligned with one another. The recessed formation 25 is formed by a cut-out portion 26 in the opposed end flanges 20 and which extends into the leading edge 27 of the opposed side walls 19 of the vertical posts. A reinforcing plate 28 is secured to a rear face 29 of each opposed end flanges 20 and bridge the cut-out portion 26 whereby to strengthen the structural end flanges 20 in the cut-out portion. The purpose of the recessed formation 25 is illustrated more clearly in FIG. 3.

Figure 2:
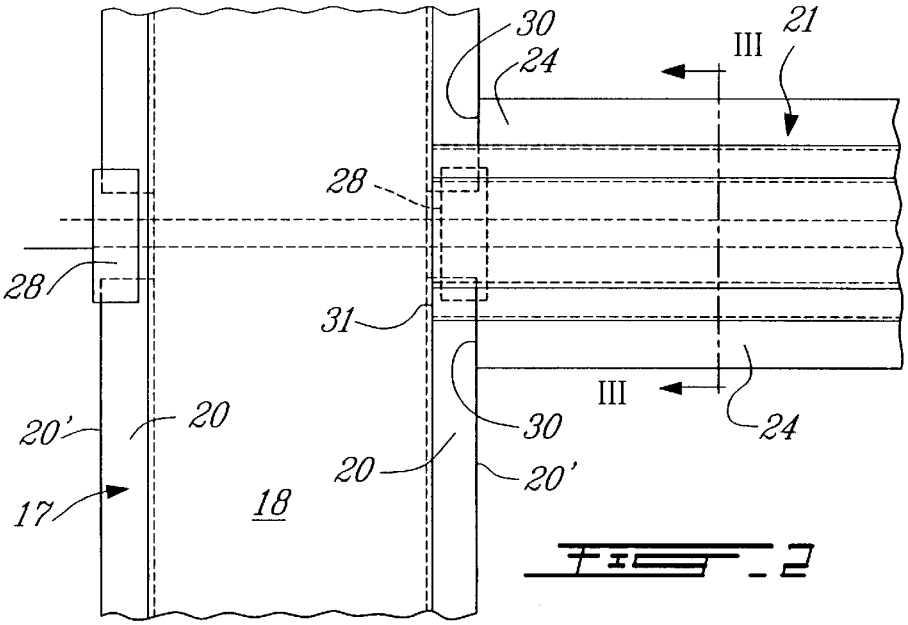
FIG. 2 is a fragmented view illustrating how the vertical side posts and the horizontal structural stiffeners are interconnected and further illustrating the recess formation formed in the opposed end flanges of the vertical posts.
Figure 3:
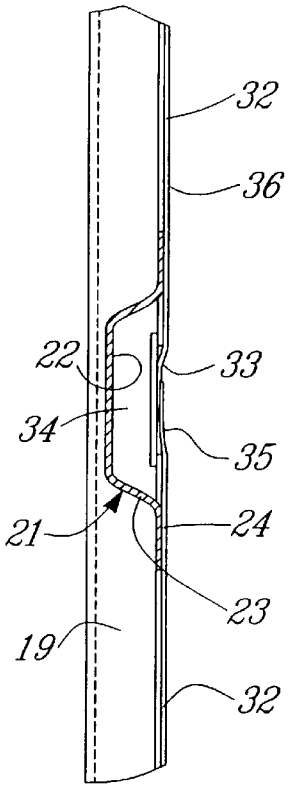
FIG. 3 is a cross-section view along cross-section lines III—III of FIG. 2 whereby to illustrate how the ferrous sheet cladding is interconnected in a recessed manner to provide for a flush inner wall surface.
Figure 4:
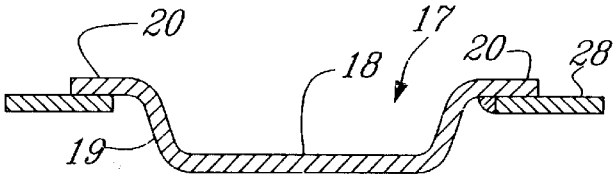
FIG. 4 is a cross-section view illustrating the construction of the vertical posts.

As shown in FIGS. 2 and 5, the horizontal stiffeners 21 have their structural end flanges 24 terminated at 30 short of its end edge 31 whereby these terminations will abut with the side edge 20' of the opposed end flanges 20 of the vertical post and these may be secured by welding (not shown) which may be made behind the vertical posts whereby the inner surface of the opposed end flanges 20 and the inner surface of the structural end flanges 24 of the post and stiffeners respectively, terminate in a flush unobstructed surface whereby to receive thereover a cladding of ferrous rectangular sheets 32, as shown in FIG. 3. Various other recessed fastening means may be used to secure the horizontal stiffeners and vertical posts. For example, they could be secured to an outer wall cladding by rivets, bolts or welding.

As can be seen in FIG. 3, the inner ferrous sheets 32 have a longitudinal recess end edge portion 33 which extends into the recessed formation 25 of the side post and the recessed inner space 34 of the horizontal stiffeners 21 whereby adjoining overlapped ends of adjacent ferrous sheets 32 may be secured to the vertical posts by suitable welding, not shown but obvious to a person skilled in the art, and to each other in the recessed formation 25. The recessed formation 25 is sufficiently deep whereby these welds and the overlap end portions 35 of opposed ferrous sheets are recessed from the inner surface 36 of the wall cladding. Accordingly, there are no projections or fasteners extending out of the surface plane to interconnect the inner side wall sheets. Therefore, if cargo, such as paper rolls, are impacted against the inner surface of the side walls of the box car, the paper will not be indented or ripped by any protruding parts. This overlap interconnection extends the full length of the side walls and also of the end walls 15.

Figure 6:
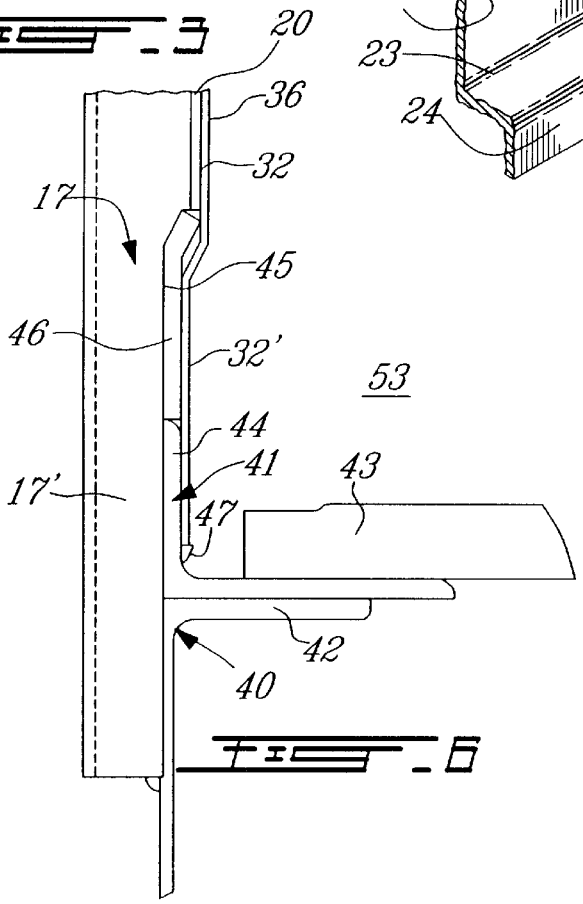
FIG. 6 is an enlarged fragmented view showing the side wall interconnection with the flooring structure and the recess connection of the lower portion of the ferrous sheet cladding with the side wall structure.

FIG. 6 shows the securement of a lower end portion 17' of the vertical post to a side sill 40 of the flooring structure 13. A floor support angle 41 is welded to the horizontal web 42 of the side sill 40 and forms part of a flooring structure on which a flooring frame 43 is attached. The side sill 40 and floor support angle 41 extend longitudinally along the flooring structure 13 of the box car. The floor support angle has a vertical web portion 44 which is secured in a recess 45 formed in the lower portion 17' of the vertical side post 17. As can be seen, the flooring frame terminates spaced from the vertical web portion 14 for access to a lower recessed end portion 32' of the lower ferrous sheet 32 forming the wall cladding. A flange extension plate 46 connects the lower edge of the opposed end flanges 20 to the vertical web portion 44. The lower end of the ferrous sheet is secured to the vertical web portion 44 by welding 47, Accordingly, there is also no obstruction nor any stiff spot in contact with the lading material in the lower end of the box car transport area adjacent the floor and the side walls.

Figure 7:
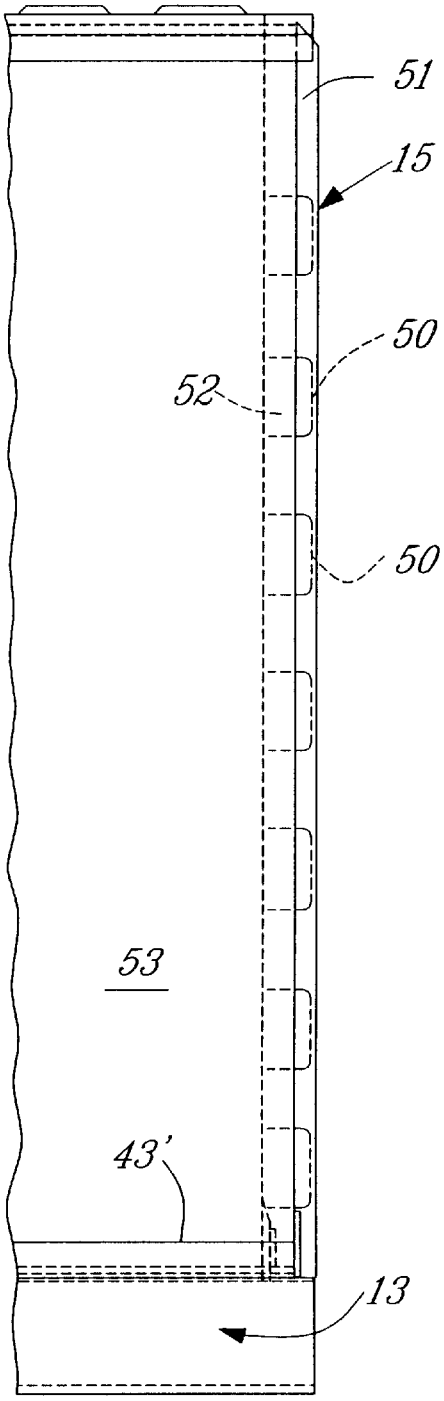
FIG. 7 is a simplified side view showing the construction of the end wall structure.
Figure 8:
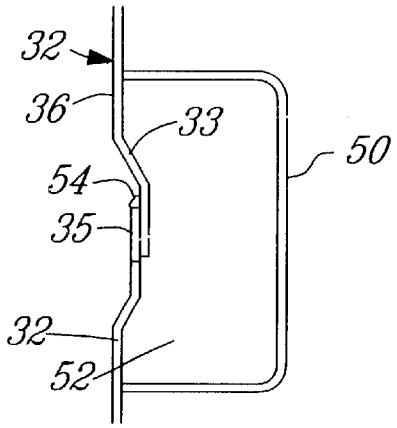
FIG. 8 is an enlarged section view showing the recessed interconnection of the ferrous sheet end wall cladding.
Figure 9:
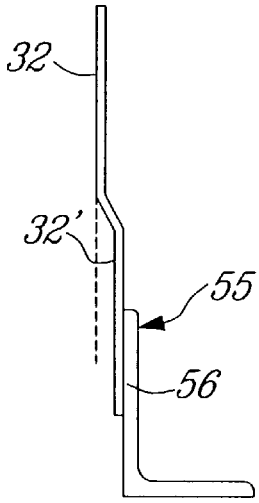
FIG. 9 is an enlarged side section view showing the ferrous sheet wall cladding interconnection along the bottom edge portion of the end walls.

FIGS. 7 to 9 illustrate the construction of the end walls 15 and as can be seen the framing of the end wall 15 is constituted by a plurality of spaced-apart horizontal stiffeners 50 secured between a pair of end post structures 51. The stiffeners 50 have a U-shaped cross-section to define channel-like members having a longitudinal open end 52. The open ends face inwardly towards the transport area 53 of the box car.

As shown more specifically in FIG. 8, the overlapped recess end portions 33 and 35 of opposed ferrous sheets 32 extend within the open area 52 of these horizontal stiffeners 50 whereby the interconnecting weld 54 is recessed from the inner surface 36 of the cladding on the end wall 15.

As shown in FIG. 9, an end sill 55 is also welded to the flooring structure 13 and has a vertical web 56 which extends recessed from the inner plane of the horizontal stiffeners 50 whereby the lower recessed portion 32' of the ferrous sheet 32 is further recessed from the inner surface 36 of the cladding adjacent the bottom wall floor surface 43', as shown more clearly in FIG. 7.

Figures 10, 11, 12, 13:
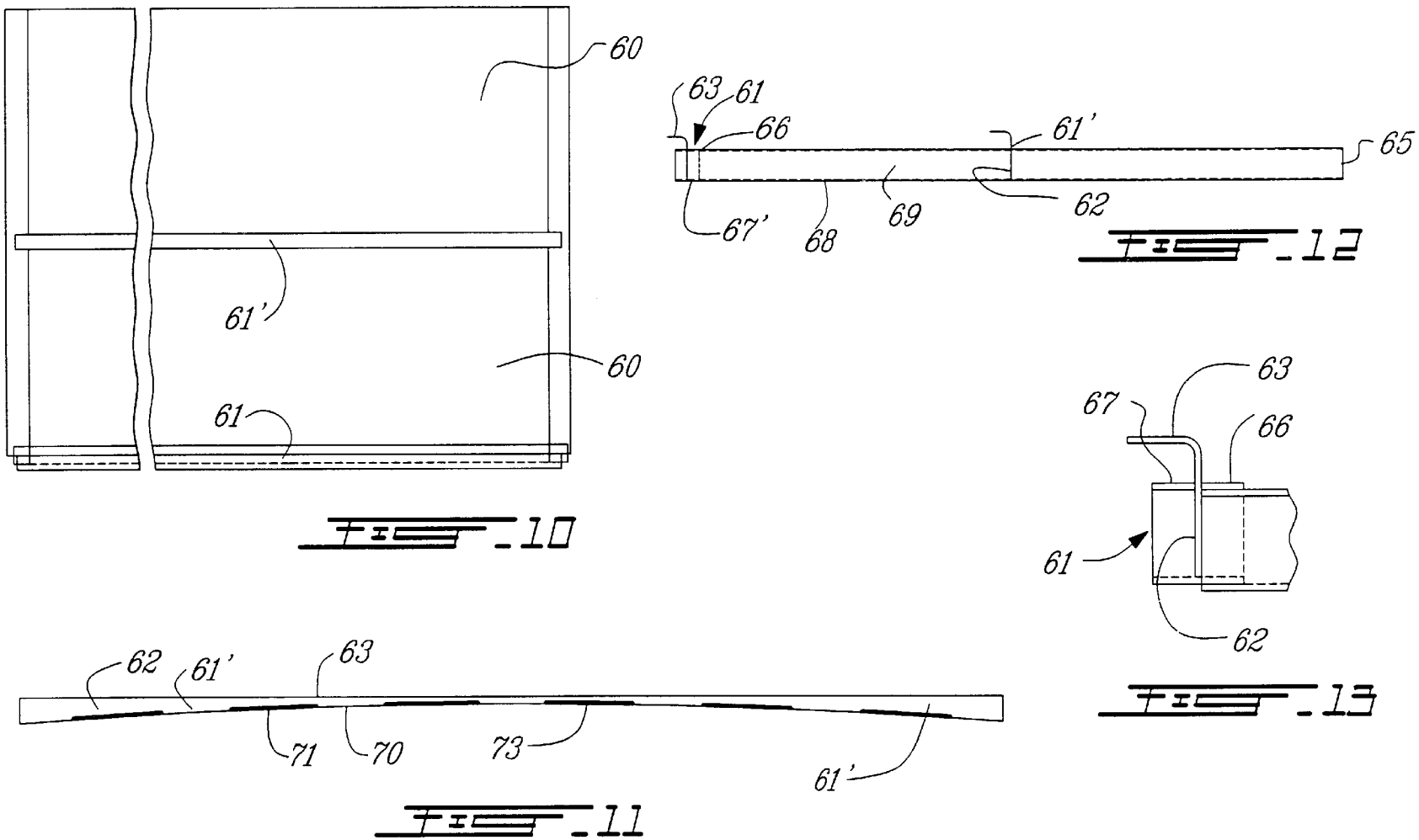
FIG. 10 is a fragmented plan view of a roof panel assembly incorporating roof stiffeners.
FIG. 11 is a side view of a roof stiffener.
FIG. 12 is a transverse cross-section view of a panel.
FIG. 13 is a partly fragmented section view showing how the end stiffeners are connected to roof panels.
Figure 14:
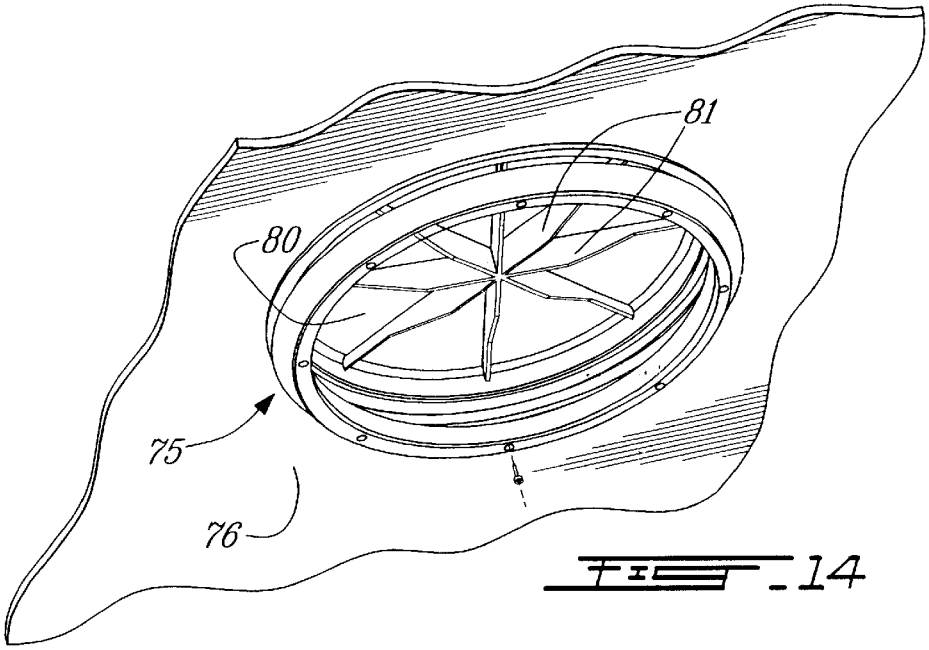
FIG. 14 is a perspective view of a skylight module constructed in accordance with one aspect of the present invention.
Figure 15:
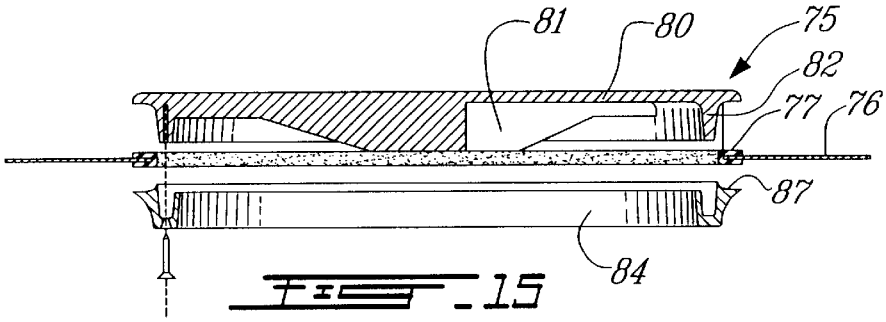
FIG. 15 is a transverse section view showing important parts of the skylight module and its interconnection with a ferrous roof sheeting of a roof panel.
Figure 16:
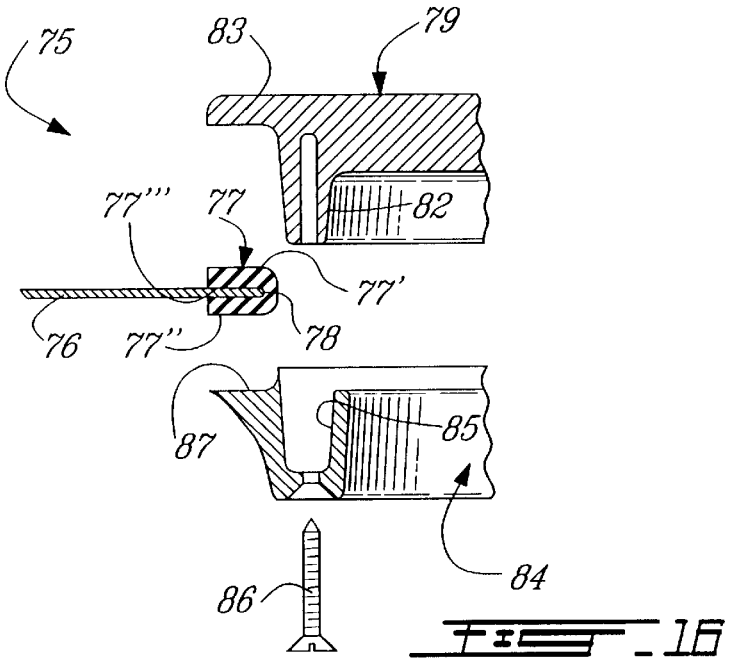
FIG. 16 is an enlarged exploded fragmented section view of FIG. 15 illustrating the interconnection of the outer circular skylight disc and the clamping inner circular ring on opposed sides of the sealing ring secured about the skylight hole.
Figure 17:
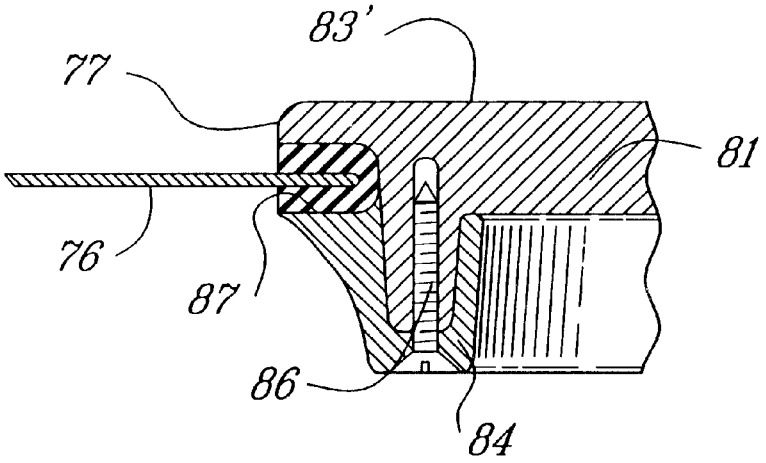
FIG. 17 is a fragmented section view showing the skylight module connected with the roof cladding showing the sealing ring clamped between the outer circular skylight disc and the inner circular ring.
Figure 18:
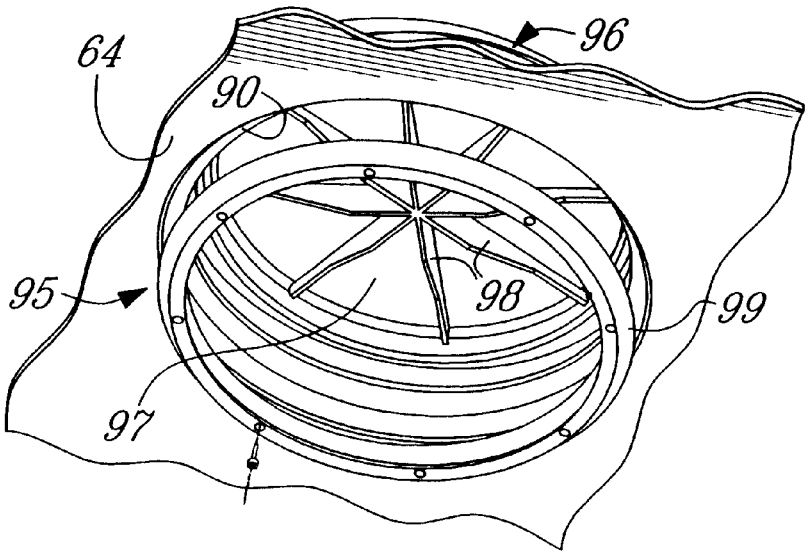
FIG. 18 is a perspective view of a skylight module constructed in accordance with a further aspect of the present invention.
Figure 10A:
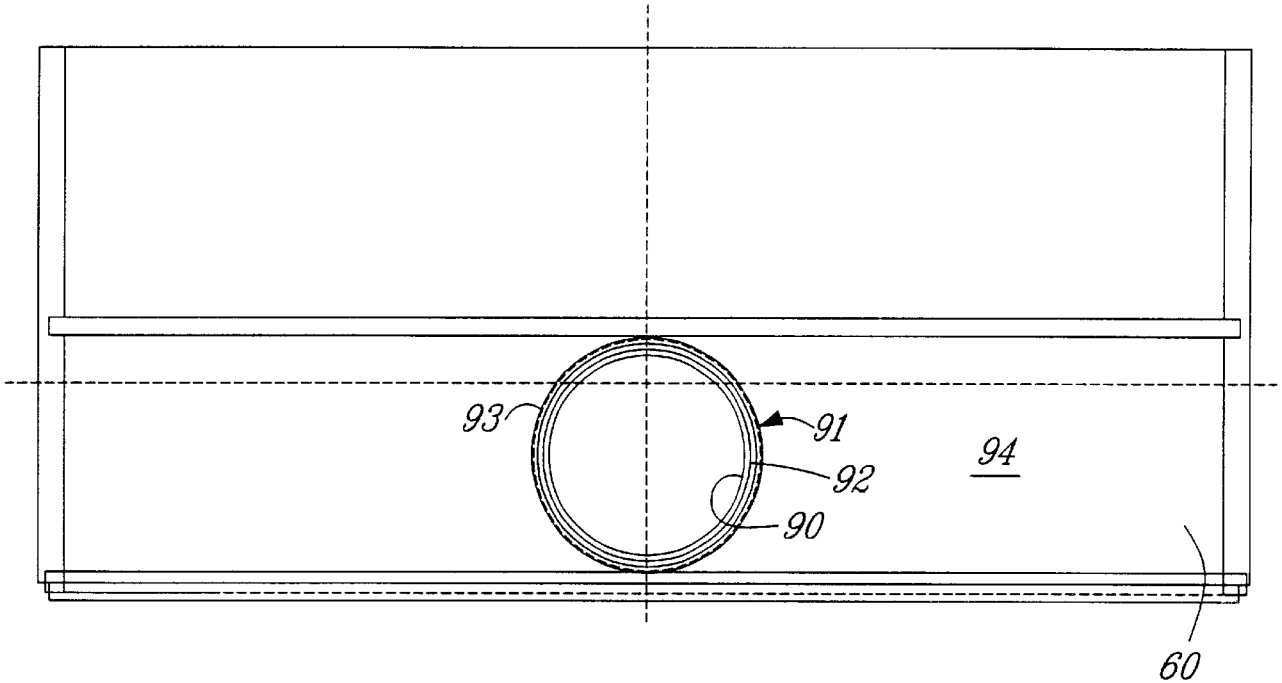
Figure 10B:
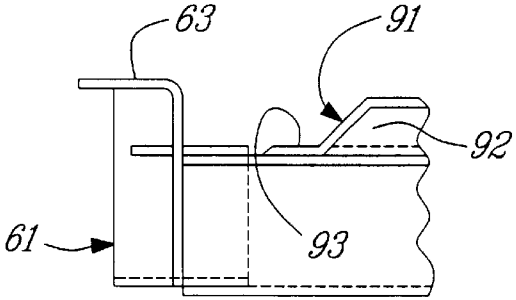

Referring now to FIGS. 10 to 13, there will be described the construction of the box car roof 16. The roof is comprised of an assembly of roof panels 60, illustrated in FIG. 10. The panel 60 comprises transverse roof stiffeners 61 and 61'. As shown in FIG. 12, the central stiffener 61' as well as the end stiffeners 61 are of L-shaped cross-section and define a vertical connecting web 62 and a transverse outer angle structural flange 63. A ferrous roof sheeting 64 is connected between the stiffeners 61 and 61' and spans between the vertical connecting webs 62. One end 65 of the panel does not have stiffeners as it interconnects with the end stiffener 61 of another panel. The stiffener 61 is provided with attachment means in the form of a seam cap assembly 66 constituted by flange 67 T-welded to web 62.

As shown in FIG. 11, the vertical connecting webs 61 or 61' are formed with a smooth arcuate lower edge 70 with the web being narrower at the center of the stiffener and larger at opposed ends thereof. The panel 60 is welded to lower edge 70 and therefore has an arcuate shape.

Referring now to FIGS. 14 to 17, there will be described the construction of skylight modules, herein a first skylight module embodiment 75 which is securable in a top roof panel sheet 76 whereby to provide ambient light into the transport area of the box car. The module 75 includes a circular sealing ring 77 which is secured about a circular hole 78 formed in the ferrous roof panel sheet 76. An outer circular skylight disc 79 is provided with a translucent panel 80 formed integral with structural ribs 81. A circumferential depending circular connecting flange 82 is also formed integral with the skylight disc 79. A seal compressing annular flange 83 is formed integral with the skylight disc and projects about the disc in an uppermost region of the depending connecting flange 62.

The skylight module 75 also comprises a clamping inner circular ring 84 which is provided with a circular cavity 85 thereabout and configured to receive an end section of the depending circular connecting flange 82 in close-fit therein. Fastener means in the form of screws 86 are provided all about the ring 84 for clamping engagement of the inner circular ring 84 with the circular connecting flange whereby to squeeze the circular sealing ring 79 between the annular flange 83 of the disc and a sealing ring clamping surface 87 of the clamping inner circular ring 84, as clearly illustrated in FIG. 17.

Figure 19:
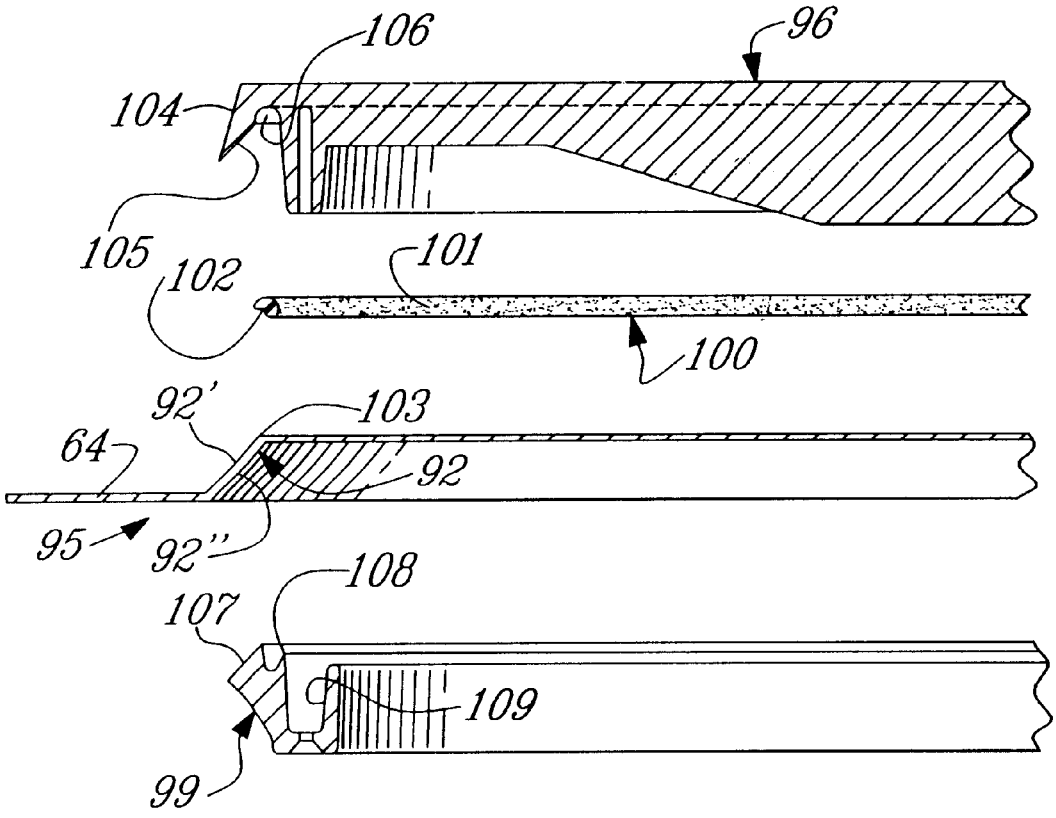
FIG. 19 is an exploded side section view, partly fragmented, showing the component parts of the skylight of FIG. 18.
Figure 20:
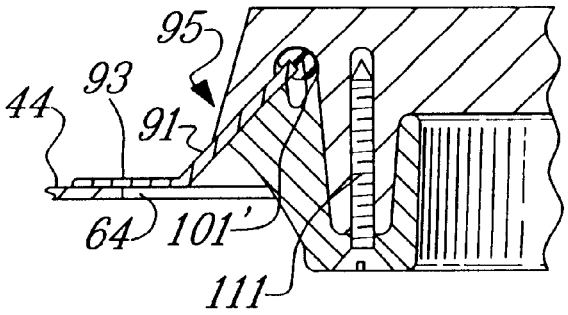
FIG. 20 is a fragmented side view showing the interconnection of the component parts of the skylight module of FIG. 18.

With reference now to FIGS. 19 and 20, there is shown another construction of a skylight module, herein module 95, which is secured to a skylight support flange 92. As hereinshown, the flange 92 may be integrally formed with the metal sheet 64 (see FIG. 19) by a stamping process. Like the other skylight embodiment above-described, the outer circular skylight disc 96 is molded as a single piece from translucent plastic material. The translucent panel section is constituted by a thin top wall 97 formed with structural ribs 98. The clamping inner circular ring 99 is also a one-piece molded part. As shown in FIG. 19 the sealing ring 100 is of partial circular cross-section and defines a circumferential smooth rounded upper section 101 and a circumferential cavitated lower side section 102 for receiving the free circular end edge 103 of the support flange 92 thereagainst. This ring 100 is quite different in construction from the flat circular sealing ring 77 of FIG. 16 where the ring was substantially rectangular in cross-section and which defined opposed flat contact surfaces 77' and 77" and a narrow circumferential slot 77"' in an outer edge thereof and dimensioned to receive a circumferential edge section of the roof sheeting 76 disposed about the circular hole.

As hereinshown, the seal compression annular flange is formed as a depending shoulder portion 104 having an angled inner face section 105 for flush contact with an outer surface 92' of the support flange 92 about the circular hole. An annular cavity 106 is disposed inwardly of a depending shoulder portion 104 adjacent the depending circular connecting flange 105. The annular cavity 106 has a cross-section corresponding to the rounded portion 101 of the sealing ring 100 for flush contact therewith.

The clamping inner circular ring 99 is also a one-piece plastic molded part. The sealing ring 99 has a clamping surface which is constituted by an angulated outer face section 107 for flush contact with an inner surface 92" of the support flange 92. An annular cavity 108 is disposed inwardly of the angulated outer face section 107 to accommodate a deformed portion 101' (see FIG. 20) of the sealing ring 100 when the skylight is assembled and the ring 100 is compressed.

The outer circular skylight disc 96 is also provided with a connecting ring 110, similar to the previous embodiment, to be received in a circular cavity 109 formed in the clamping inner circular ring 99. A plurality of fasteners 111 secures the outer circular skylight disc 96 to the clamping inner circular ring 99 in a manner as illustrated in FIG. 20.

Accordingly, both of the skylight structures as above-described provide for a tight seal, leak-proof skylight construction and attachment to a railway box car roof. They are also easily connectable to many existing box car roof structures.

It is within the ambit of the present invention to cover any obvious modifications of the preferred examples of the improved box car construction described herein, provided such modifications fall within the scope of the appended claims.

We claim:

1. A railway box car body structure comprising a flooring structure, a side wall on both longitudinal sides of said flooring structure and extending above said flooring structure, an end frame at opposed transverse ends of said flooring structure between opposed ends of said side walls, a roof frame constituting an upper surface of said body structure, said side wall having a plurality of spaced-apart vertical side posts, said vertical side posts each having a hat-shaped cross-section having a bottom wall portion, opposed side walls and opposed end flanges extending in a common plane; horizontal structural stiffeners secured between said vertical side posts, said stiffeners defining a recessed wall portion aligned with a recessed formation formed in said opposed end flanges of said vertical side posts, and ferrous sheet members secured to said side wall and end frames by recessed connections formed in said recessed wall portions to form flush inner side and end walls of said railway box car.

2. A railway box car body structure as claimed in claim 1 wherein said ferrous sheet members are rectangular sheets, said sheets having a horizontal recessed end edge portion extending into said recessed formation of said side posts and said recessed wall portions of said stiffeners to be interconnected by said recessed connections disposed outwardly of an inner wall surface of said sheets throughout a transport area of said railway car.

3. A railway box car body structure as claimed in claim 2 wherein said longitudinal recessed end edge portions are overlapped and extend along a full length of said side and end walls of said body structure.

4. A railway box car body structure as claimed in claim 1 wherein said recessed formation in said opposed end flanges of said vertical posts are constituted by a cut-out section formed in each said opposed end flanges and extending into a leading edge of said opposed side walls, said cut-out sections being aligned with one another, and a reinforcing plate secured to a rear face of each said opposed end flanges and bridging said cut-out portion.

5. A railway box car body structure as claimed in claim 2 wherein said vertical side posts are secured at a lower end portion thereof to a side sill of said flooring structure, a floor support angle forming part of said flooring structure and extending longitudinally along a lower end portion of said side and end walls, said floor support angle having a vertical and horizontal web portion, said vertical web portion being recessed from an inner surface of said opposed end flanges of said vertical side posts and a flooring frame extending over a portion of said horizontal web portion and terminating spaced from said vertical web portion to form an open unobstructing peripheral bottom joint between said flooring material and said side and end walls in said transport area.

6. A railway box car body structure as claimed in claim 5 wherein said longitudinal recessed end edge portion of a lower one of said ferrous sheet members extends over a portion of an inner face of said vertical web portion, and a weld formed between at least portions of an end edge of said recessed longitudinal end formation and said inner face of said vertical web portion recessed from said inner wall surface of said sheets.

7. A railway box car body structure as claimed in claim 6 wherein said horizontal stiffeners are straight stiffening metal members of hat-shaped cross-section defining said recessed wall and opposed elongated transverse stiffening arms, said stiffening arms being of inferior width to a width of said opposed side walls of said vertical side posts, said vertical side posts and said stiffeners being welded together and providing increased bulging stiffness in a lowermost area of a transport area of said railway car.

8. A railway box car body structure as claimed in claim 7 wherein there are at least one row of said horizontal structural stiffeners along at least said side walls of said body structure, there being one or more rows of horizontal structural stiffener between opposed ones of said plurality of spaced-apart vertical side posts.

9. A railway box car body structure as claimed in claim 2 wherein said end frame has a plurality of spaced-apart horizontal stiffeners secured between a pair of end post structures, said stiffeners having a U-shaped cross-section to define channel-like members having a longitudinal open end between side arms thereof, said open ends facing inwardly towards said transport area, said recess weld seam being formed in selected ones of said channel-like members recessed from said inner wall surface of said sheets.

10. A railway box car body structure as claimed in claim 1 wherein said roof framing is comprised by a roof panel assembly having spaced-apart transverse roof stiffeners, said roof stiffeners being of L-shaped cross-section defining a vertical connecting web and a transverse outer angled structural flange, and ferrous roof sheeting secured to said connecting webs of opposed transverse stiffeners spaced below said structural flange, said roof sheeting being secured to said webs by attachment means to provide for a weather-proof connection and a flush unobstructed interior roof surface.

11. A railway box car body structure as claimed in claim 10 wherein said vertical connecting web has a smooth arcuate lower edge, said web being narrower at a center of said roof stiffener and larger at opposed ends thereof, said stiffeners having opposed connecting flanges secured to said web and projecting in alignment from opposed side faces of said web at a bottom end thereof.

12. A railway box car body structure as claimed in claim 1 wherein said roof framing includes one or more skylight modules, said modules each having a circular sealing ring secured about a circular hole formed in a ferrous roof sheeting of said roof framing, an outer circular skylight disc having a translucent panel section and a circumferential depending circular connecting flange, a seal compressing annular flange projecting about said disc in an uppermost region of said depending connecting flange, and a clamping inner circular ring having a circular cavity thereabout configured to receive an end section of said depending circular connecting flange in close fit therein, and fastener means for clamping engagement of said inner circular ring with said circular connecting flange whereby to squeeze said circular sealing ring between said annular flange of said disc and a sealing ring clamping surface of said clamping inner circular ring.

13. A railway box car body structure as claimed in claim 12 wherein a skylight support ring having a circular attaching flange and an upwardly extending support flange is secured to said roof sheeting about said circular hole, said circular sealing ring being secured about a free circular end edge of said support flange about said circular hole.

14. A railway box car body structure as claimed in claim 12 wherein said fastener means are screw fasteners disposed in holes formed in said clamping inner circular ring and bores in said depending circular connecting flange.

15. A railway box car body structure as claimed in claim 13 wherein said fastener means are screw fasteners disposed in holes formed in said clamping inner circular ring and bores in said depending circular connecting flange.

16. A railway box car body structure as claimed in claim 12 wherein said outer circular skylight disc is molded as one piece from translucent plastic material, said translucent panel section being constituted by a thin top wall formed with bottom molded structural ribs.

17. A railway box car body structure as claimed in claim 16 wherein said clamping inner circular ring is also a one-piece molded part, said sealing ring clamping surface being an outer flat horizontal surface of a circumferential ledge of said ring.

18. A railway box car body structure as claimed in claim 12 wherein said circular sealing ring is of substantially rectangular cross-section defining opposed flat contact surfaces and a narrow circumferential slot in an outer edge thereof intermediate said contact surfaces and dimensioned to receive a circumferential edge section of said roof sheeting about said circular hole.

19. A railway box car body structure as claimed in claim 13 wherein said seal compression annular flange projecting about said disc has a depending shoulder portion with an angled inner face section for flush contact with an outer surface of said support flange about said circular hole, and an annular cavity inwardly of said depending shoulder portion adjacent said depending circular connecting flange, said annular cavity having a cross-section configured to the cross-section of a portion of said circular sealing ring to be received therein.

20. A railway box car body structure as claimed in claim 16 wherein said seal compression annular flange projecting about said disc has a depending shoulder portion with an angled inner face section for flush contact with an outer surface of said support flange about said circular hole, and an annular cavity inwardly of said depending shoulder portion adjacent said depending circular connecting flange, said annular cavity having a cross-section configured to match the cross-section of a portion of said circular sealing ring to be received therein.

21. A railway box car body structure as claimed in claim 20 wherein said clamping inner circular ring is also a one-piece molded part, said sealing ring clamping surface having an angulated outer face section for flush contact with an inner surface of said support flange about said circular hole, and an annular cavity inwardly of said angulated outer face section to accommodate a deformed portion of said circular sealing ring when compressed.

22. A railway box car body structure as claimed in claim 13 wherein said circular sealing ring is of partial circular cross-section defining a circumferential smooth rounded upper section and a circumferential cavitated lower side section for receiving said free circular end edge of said support flange therein.

23. A railway box car body structure comprising a flooring structure, a side wall on both longitudinal sides of said flooring structure and extending above said flooring structure, an end frame at opposed transverse ends of said flooring structure between opposed ends of said side walls, a roof frame constituting an upper surface of said body structure, said roof framing being comprised by a roof panel assembly having spaced-apart transverse roof stiffeners, said roof stiffeners being of L-shaped cross-section defining a vertical connecting web and a transverse outer angled structural flange, and ferrous roof sheeting secured to said connecting webs of opposed transverse stiffeners spaced below said structural flange, said roof sheeting being secured to said webs by attachment means to provide for a weather-proof connection and a flush unobstructed interior roof surface.

24. A railway box car body structure as claimed in claim 23 wherein said vertical connecting web has a smooth arcuate lower edge, said web being narrower at a center of said roof stiffener and larger at opposed ends thereof, said stiffeners having opposed connecting flanges secured to said web and projecting in alignment from opposed side faces of said web at a bottom end thereof.

* * * * *